United States Patent [19]

Joseph

[11] 4,112,707

[45] Sep. 12, 1978

[54] JEWELRY ARTICLE WITH RADIOMETER THEREIN

[76] Inventor: Robert Joseph, 25 Hahn Pl., Kitchener, Ontario, Canada, N2M 1R4

[21] Appl. No.: 721,347

[22] Filed: Sep. 8, 1976

[51] Int. Cl.[2] ..... A44C 17/00; A44C 25/00

[52] U.S. Cl. ..... 63/31

[58] Field of Search ..... 63/31, 13; 40/125, 138, 40/139, 106.3; 250/338; 73/355 R

[56] References Cited

U.S. PATENT DOCUMENTS

| | | | |
|---|---|---|---|
| 155,682 | 10/1874 | Steinheuer | 63/13 |
| 221,178 | 11/1879 | Miller | 63/13 |
| 251,068 | 12/1881 | Russell | 63/13 |
| 324,757 | 8/1885 | Dunham | 63/13 |
| 483,214 | 9/1892 | Gaynor | 63/13 |
| 609,332 | 8/1898 | Donaldson | 46/50 |
| 718,708 | 1/1903 | Geiger et al. | 63/13 |
| 799,058 | 9/1905 | Huber et al. | 63/13 |
| 2,352,361 | 6/1944 | Ballestero | 40/106.3 |
| 2,682,759 | 12/1951 | Chalikian et al. | 63/13 |
| 3,129,004 | 4/1964 | Ritzler | 273/143 R |

FOREIGN PATENT DOCUMENTS

| | | | |
|---|---|---|---|
| 934,670 | 1/1948 | France | 63/31 |
| 1,076,472 | 4/1954 | France | 250/338 |
| 337,350 | 5/1959 | Switzerland | 63/31 |

OTHER PUBLICATIONS

Radel — The Washington News, p. 30, edition of Mar. 4, 1954.

Jones — The Sunday Star Magazine, Washington, DC., edition of Aug. 12, 1956.

LaPine Physics Catalog of 1967, p. 43.

*Primary Examiner*—F. Barry Shay

*Attorney, Agent, or Firm*—Stevens, Davis, Miller & Mosher

[57] ABSTRACT

An item of jewelry, such as an earring, including an evacuated globe housing a plurality of rotatable radiometer vanes which turn when exposed to light.

4 Claims, 2 Drawing Figures

JEWELRY ARTICLE WITH RADIOMETER THEREIN

BACKGROUND OF THE INVENTION

This invention relates to jewelry items, and more particularly to earrings, necklaces, pendants and the like provided with a rotating element to enhance its appearance and attract attention to the wearer.

The main function of jewelry is to adorn and attract attention to the person of the wearer. This invention provides such an article of adornment by providing an element which rotates when exposed to light enhancing the aesthetic appearance of the jewelry article and the person of the wearer.

SUMMARY OF THE INVENTION

In accordance with the invention, a transparent glass chamber, such as a globe is evacuated and provided with a plurality of alternating dark and light vanes attached to a hub rotatably mounted between adjacent ends of a pair of fixed shafts. One shaft terminates in a ring which can be connected to an earring clasp or a necklace chain. When the vanes are exposed to light, they function as a radiometer, rotating about the end of the adjacent shafts.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
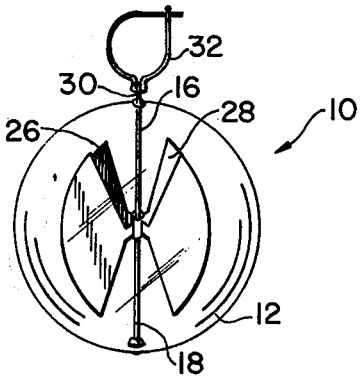
FIG. 1 is a perspective view of a typical jewelry article of the present invention.
Figure 2:
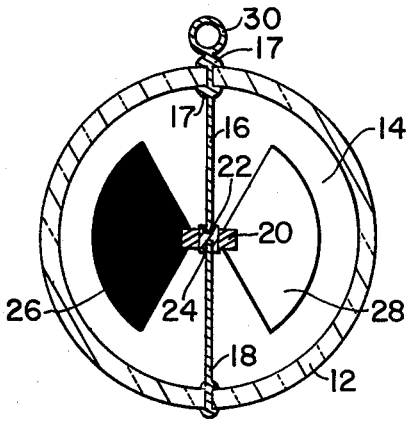
FIG. 2 is a longitudinal cross-sectional view of the jewelry article of FIG. 1.

Referring now in detail to the drawing, wherein like numerals indicate like elements throughout the several views, a typical jewelry article 10 of the present invention may comprise an earring in the shape of a glass globe 12 whose interior 14 is evacuated or substantially free of air.

An upper shaft 16 is fixed by beads 17 along a radius of globe 12 to the spherical wall of the globe 12. A lower shaft 18 is also fixed by beads to the spherical wall of globe 12 coaxially along an opposite radius. A hub 20 having an upper and lower facing cup-shaped depression 22 and 24, respectively, is rotatably mounted between the adjacent ends of shafts 16 and 18.

Hub 20 mounts a plurality of alternating dark and light vanes 26 and 28. When light strikes the vanes, it transfers heat to each one — but not to the same degree. The lighter vanes 28 reflects the heat rays, and the dark vanes 26 absorbs the rays. When the few remaining air particles within evacuated interior 14 of globe 12 strike the light reflective vanes 28 they take on very little energy and do not bounce off very fast. However, when the air particles strike the dark vanes 26, they take on a great deal of energy and bounce off at a tremendous speed. This imbalance causes the vanes 26, 28 and hub 20 to rotate, as in a radiometer, between the ends of shafts 16 and 18.

One end of shaft 16 extends out of globe 12 and terminates in a ring 30. An ear clasp 32 can be secured to ring 30 or a necklace chain, as desired.

I claim:

1. An article of jewelry comprising:

an evacuated substantially transparent chamber, means within said chamber for mounting a plurality of vanes for rotation about an axis, each said vane having a light absorbing surface on one side and a light reflecting surface on the other, said mounting means including a pair of coaxial shafts fixed to said chamber having spaced but adjacent ends, and a hub rotatably mounted between the ends of said shafts upon which said vanes are mounted, a ring attached to one of said shafts exteriorly of said chamber, and means on said ring for attaching and securing said chamber to a person.

2. The article of jewelry of claim 1 wherein said attaching and securing means includes a clasp on said ring.

3. The article of jewelry of claim 1 wherein said chamber is a globe.

4. The article of jewelry as in claim 1 wherein said hub includes upper and lower cup-shaped depressions in point contact with the ends of said shafts.

* * * * *